US005615733A

United States Patent [19]

Yang

[11] Patent Number: 5,615,733

[45] Date of Patent: Apr. 1, 1997

[54] ON-LINE MONITORING SYSTEM OF A SIMULATED HEAT-EXCHANGER

[75] Inventor: Ming-Chia Yang, Taipei, Taiwan

[73] Assignee: Helio-Compatic Corporation, Taipei, Taiwan

[21] Appl. No.: 641,574

[22] Filed: May 1, 1996

[51] Int. Cl.[6] ..... F23G 13/00

[52] U.S. Cl. ..... 165/11.1; 165/95; 374/7; 374/43; 374/112

[58] Field of Search ..... 165/11.1, 95; 374/7, 374/43, 112

[56] References Cited

U.S. PATENT DOCUMENTS

| | | | |
|---|---|---|---|
| 4,390,058 | 6/1983 | Otake et al. | 165/11.1 |
| 4,729,667 | 3/1988 | Blangetti et al. | 165/11.1 |
| 4,762,168 | 8/1988 | Kawabe et al. | 165/11.1 |
| 4,766,553 | 8/1988 | Kaya et al. | 165/11.1 |
| 5,353,653 | 10/1994 | Watanabe et al. | 165/11.1 |
| 5,385,202 | 1/1995 | Drosdziok et al. | 165/11.1 |
| 5,429,178 | 7/1995 | Garey et al. | 165/11.1 |

FOREIGN PATENT DOCUMENTS

| | | | |
|---|---|---|---|
| 0928163 | 5/1982 | U.S.S.R. | 165/11.1 |
| 2171506 | 8/1986 | United Kingdom | 165/11.1 |

*Primary Examiner*—John K. Ford
*Attorney, Agent, or Firm*—Bacon & Thomas

[57] ABSTRACT

A on-line monitoring system of a simulated heat-exchanger which includes a plurality of temperature sensors adapted to detect the temperatures of cold water and hot water at respective water inlets and water outlets, a flowrate detector adapted to detect the flow rate of cold water, an A/D converter adapted to convert detected temperature signals and flowrate signal into corresponding digital signals, and a microprocessor adapted to calculate total heat transmission rate subject to the data obtained from the A/D converter and to calculate the heat transmission constant of the heat exchanging tube inside the heat exchanging chamber, then to store the calculated data in a memory for use as a reference value for the calculation of a next heat transmission rate so as to further calculate the heat transmission rate and thickness of fouling of the heat exchanging tube by comparing the latest coefficient of heat transmission with the previous coefficient of heat transmission, permitting the calculated result to be shown through an output device such as a monitor, the change of coefficient of heat transmission being caused by the deposit of fouling in the inside wall of the heat exchanging tube.

14 Claims, 2 Drawing Sheets

ON-LINE MONITORING SYSTEM OF A SIMULATED HEAT-EXCHANGER

BACKGROUND OF THE INVENTION

The present invention relates to a on-line monitoring system of a simulated heat-exchanger which directly reads out the rate of fouling or loss of heat transmission and shows the readings through a monitor, so that the operator can directly monitor the efficiency of the heat exchanging process.

Conventional heat exchanging rate monitoring apparatus commonly use one or more heat exchanging tubes to monitor heat exchanging ratio or the rate of fouling. The heat exchanging tubes are installed in the heat exchanging chamber and used as heat exchanging media, and steam or electric heat is used as heat source outside the heat exchanging tubes. When in actual practice, the heat exchanging tubes are removed from the installation 45–60 days after operation, then dried, and then weighed so as to obtained a weight W1. Then, fouling is removed from the heat exchanging tubes, and then the heat exchanging tubes are weighed again so as to obtain a weight W2. A weight difference $\Delta W = W1 - W2$ is thus obtained. Therefore, the person who monitors the system can define the fouling rate of the heat exchanging tubes subject to the value of $\Delta W$ thus obtained. Alternatively, transparent tubes may be used and installed in the heat exchanging chamber to guide water through, and heat source is mounted outside the transparent tubes. When heated, a heat exchanging process is produced between the inside of the transparent tubes and the outside thereof. 45–60 days after operation, the transparent tubes are removed from the heat exchanging chamber, and then the weight W1, the weight W2, and the weight difference $\Delta W$ between W1 and W2 are respectively calculated, so that the fouling rate can be defined.

The aforesaid conventional monitoring methods commonly employ an indirect measuring procedure to define the fouling rate of the heat exchanging tubes subject to the value of $\Delta W$. These methods cannot help the operator know the heat transmission rate or fouling rate of the heat exchanging tubes from on-line.

SUMMARY OF THE INVENTION

The present invention has been accomplished under the circumstances in view. It is the main object of the present invention to provide a on-line monitoring system of a simulated heat-exchanger which directly reads out the fouling rate or reduction of heat transmission rate of the heat exchanging tube, and permits the operator to directly monitor the washing process and its effect when a fouling removing agent is added.

DETAILED DESCRIPTION OF THE PREFERRED EMBODIMENT

Figure 1:
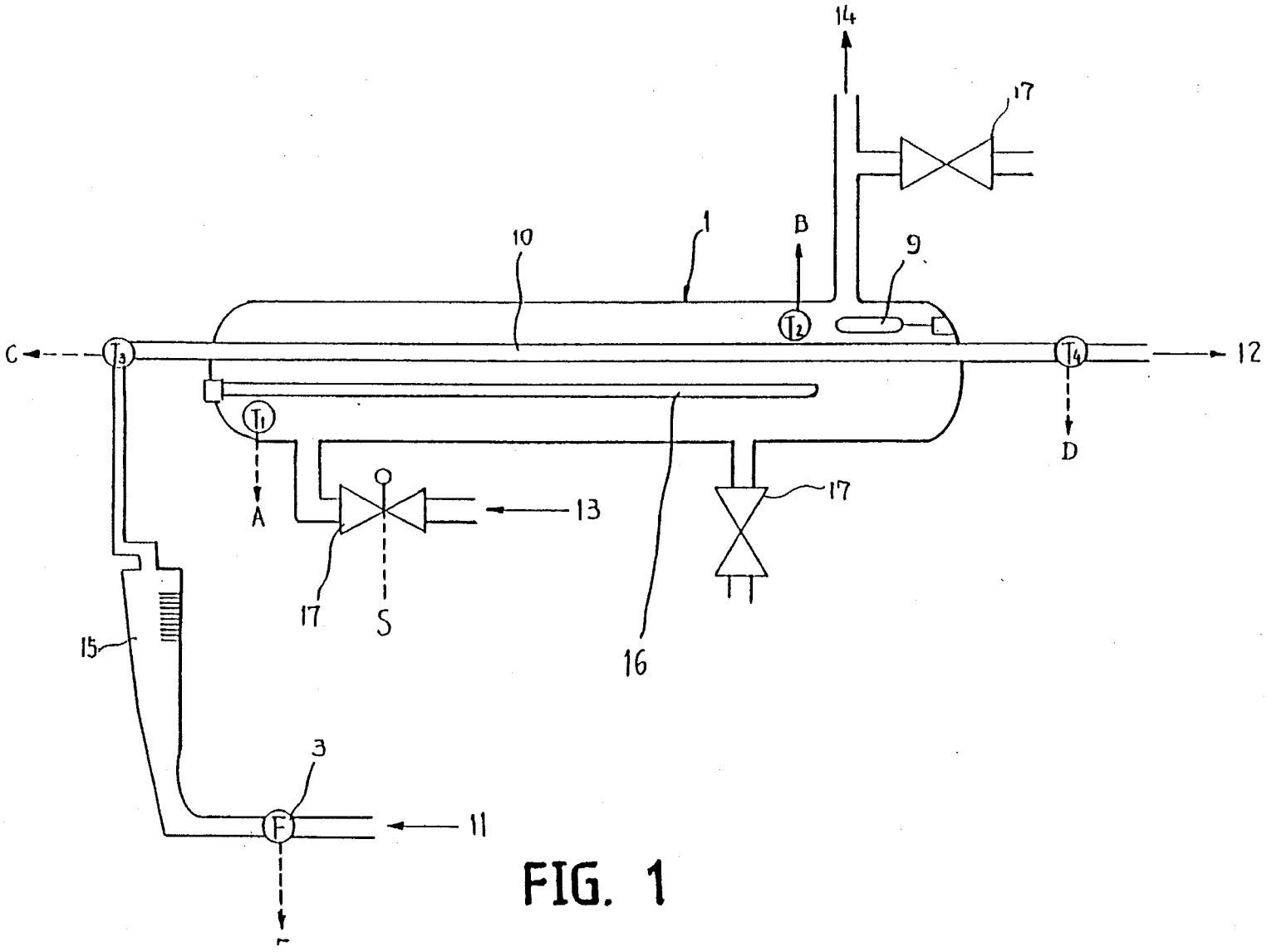
FIG. 1 is a front plain view of the present invention, showing the hardware arrangement of the on-line monitoring system of a simulated heat-exchanger thereof.
Figure 2:
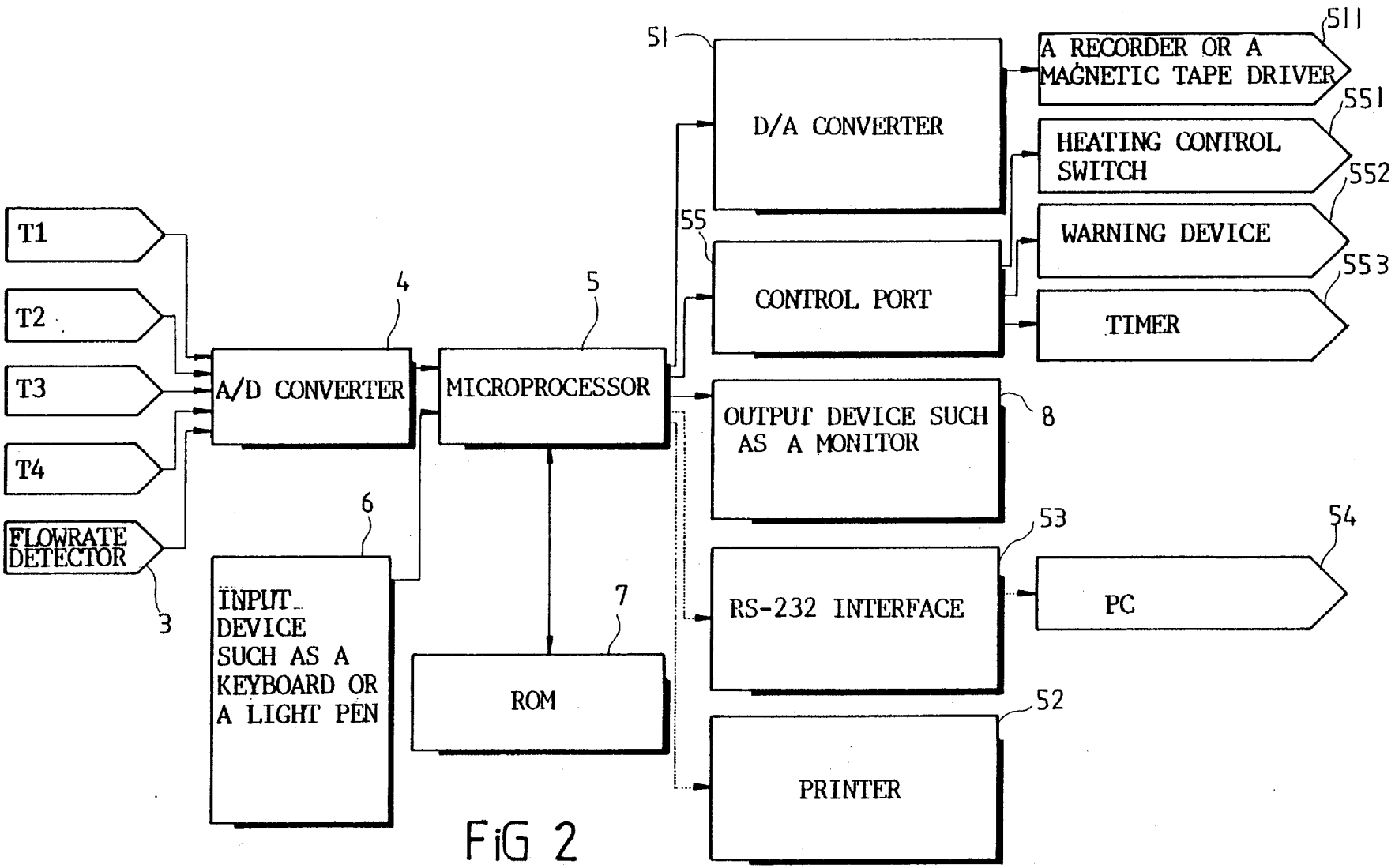
FIG. 2 is a block diagram of the present invention.

Referring to FIGS. 1, and 2, a on-line monitoring system of a simulated heat-exchanger in accordance with the present invention is generally comprised of a heat exchanging chamber 1, temperature sensors (for example, thermoelectric couplings) T1, T2, T3, T4, a flowrate detector 3, an A/D converter 4, a microprocessor 5, an input device i.e. a keyboard 6, a ROM (read only memory) 7, and an output device i.e. a monitor 8.

Referring to FIGS. 1 and 2 again, the heat exchanging chamber 1 provides a space for the performance of a heat exchanging process, having at least one heat exchanging tube 10 passing therethrough in the longitudinal direction, a hot water inlet 13, and a hot water outlet 14. The heat exchanging tube 10 has a cold water inlet 11 at one end, and a cold water outlet 12 at an opposite end. One temperature sensor T3 is installed in the heat exchanging tube 10 outside the heat exchanging chamber 1 near the cold water inlet 11 to detect the temperature of cold water passing through the cold water inlet 11. One temperature sensor T4 is installed in the heat exchanging tube 10 outside the heat exchanging chamber 1 near the cold water outlet 12 to detect the temperature of heat exchanged water passing out of the heat exchanging tube 10 through the cold water outlet 12. The temperature signals C, D of the temperature sensors T3, T4 are respectively transmitted to the A/D converter 4, and converted by it into corresponding digital signals. An area type flow meter 15 is mounted in the heat exchanging tube 10 outside the heat exchanging chamber 1 so that the operator can visually check the flowrate and velocity of flow of cold water passing through the heat exchanging tube 10. Alternatively, a flowrate detector 3 may be installed in the heat exchanging tube 10 outside the heat exchanging chamber 1 near the cold water inlet 11 to directly detect the flow rate of the heat exchanging tube 10 and to provide the detected flowrate signal E to the A/D converter 4 for converting into a corresponding digital signal. Temperature sensors T1, T2 are respectively installed inside the heat exchanging chamber 1 adjacent to the hot water inlet 13 and the hot water outlet 14 to detect the inside temperature of the heat exchanging chamber 1, the temperature signals A, B of the temperature sensors T1, T2 are respectively transmitted to the A/D converter 4, and converted by it into corresponding digital signals. A heat source (for example, a low-pressure saturated evaporator) 16 is mounted inside the heat exchanging chamber 1 to provide heat to the heat exchanging tube 10. The temperature of the heat source 16 is preferably set within 100°–105° C. A plurality of solenoid valves 17 are installed in the heat exchanging chamber 1, and controlled by a signal S. The signal S is controlled by the microprocessor 5 to open/close the solenoid valves 17.

Referring to FIG. 2 again, the A/D converter 4 has a plurality of input terminals respectively connected to the output ends of the temperature sensors T1, T2, T3, T4, and the output end of the flowrate detector 3. When the A/D converter 4 receives the temperature signals A, B, C, D of the temperature sensors T1, T2, T3, T4 and the flowrate signal E of the flowrate detector 3, it converts the received signals into corresponding digital signals, and then sends the digital signals to the microprocessor 5, so that the microprocessor 5 can directly calculate from on-line the heat transmission constant by means of the execution of its software program and subject to the law of heat transmission and total heat transmission rate. The on-line monitoring system of the present invention is operated subject to the law of heat transmission, which was proposed by French scientist Fourier in 1882, that total heat flow rate Q is directly proportional to heat transmission area A and temperature difference of object DT, and indirectly proportional to thickness of object DX, i.e., $$Q1 = -KA\frac{DT}{DX} \quad (1)$$

in which:

"-": heat transmission from high temperature toward low temperature

Q: coefficient of heat conductivity

K: heat transmission constant

A: heat transmission area

DT: temperature difference at heat transmission surface

DX: thickness of heat transmission surface Therefore, if the average temperature difference of the internal temperature difference and external temperature difference of the heat exchanging tube 10 in the heat exchanging chamber 1 is: [(T1-T3)+(T2-T4)]/2, the area of the heat exchanging tube is A and its thickness is DX, thus the total heat flow rate is:

$$Q1 = -KOA\frac{(T1-T3)+(T2-T4)}{2DX}$$

Further, please see also FIG. 1, when viewing the temperature changes of cold water at the two opposite ends of the heat exchanging tube 10, the following equation is obtained subject to the equation of "total heat transmission rate":

$$Q2=W\times C\times \Delta T \quad \ldots (2)$$

in which: Q2: total heat absorption capacity

W: weight of heat absorbing liquid

C: specific heat of heat absorbing liquid

ΔT: temperature difference before and after heat absorption (T3, T4).

Therefore, if the temperature difference between the two opposite ends of the heat exchanging tube before and after heat absorption is ΔT=T4-T3, the weight or flow rate of cold water is W, and the specific heat is C, thus the total heat absorption capacity is:

$$Q2=WC(T4-T3)$$

According to the aforesaid equations (1) and (2), if Q1=Q2, thus the heat transmission constant K0 of the heat exchanging tube 10 is:

$$KO = \frac{-2xDXxWxCx(T4-T3)}{Ax[(T1-T3)+(T2-T4)]} \quad (3)$$

Referring to FIG. 2 again, the microprocessor 5 is connected to a keyboard 6, a ROM 7, a monitor 8, and an A/D converter 51. The ROM 7 can be a DRAM, flash memory, etc. The A/D converter 51 has an output terminal connected to a recorder 511 or a magnetic tape driver. The microprocessor 5 uses the ROM 7 to store the law of heat transmission, computing program of total heat transmission rate and heat transmission constant, etc., shows the computed result through the output device such as the monitor 8, and provides analog output signals corresponding to the computed result (the computed result is converted by the D/A converter 51 into a corresponding analog signal, and then the analog signal is recorded in the recorder 511). The input device such as the keyboard 6 or a light pen is adapted for setting the upper limit and lower limit of the inside temperature of the heat exchanging chamber 1, and directly controlling the opening/closing of the solenoid valves 17, i.e., when the inside temperature of the heat exchanging chamber 1 drops below the lower limit value, it is immediately detected by the temperature sensors T1, T2, and the control signal S of the microprocessor 5 turns on the solenoid valves 17 to let hot water flow into the heat exchanging chamber 1; on the contrary, when the inside temperature of the heat exchanging chamber 1 surpasses the upper limit value, the control signal S of the microprocessor 5 turns off the solenoid valves 17 to stop hot water from flowing into the heat exchanging chamber 1.

Furthermore, the microprocessor 5 is connected to a printer 52, and a personal computer 54 through a RS-232 interface, therefore the data of the temperature signals A, B, C, D of the temperature sensors T1, T2, T3, T4, the flow rate signal E of the flowrate detector 3, heat transmission constant, . . . etc., can be automatically printed out through the printer 52. The microprocessor 5 can be connected to a heating control switch 551, a warning device 552, and a timer 553 through a control port 55 thereof. Therefore, the microprocessor 5 can control the heating range through the heating control switch 551, or give to the operator a warning signal through the warning device 552 when the flowrate is below a predetermined low level. When the microprocessor 5 receives the respective digital signals from the A/D converter 4, it immediately computes heat transmission constant subject to the law of heat transmission and total heat transmission rate, shows computed heat transmission constant through the monitor 8 and stores it in the ROM 7 for use as a reference in further heat transmission rate comparison. The microprocessor 5 regularly records heat transmission constant (heat transmission constant is computed once per 0.5 second). After a certain length of time in continuous operation, the inside wall of the heat exchanging tube 10 produces a heat resistance because of the effect of fouling, causing the coefficient of heat conductivity to drop, and therefore the value of the newly computed coefficient of heat conductivity Kt is relatively reduced. At this stage, heat transmission rate can be calculated by comparing the new coefficient of heat conductivity Kt with the previous coefficient of heat conductivity K0 as follows:

$$\text{HEAT TRANSMISSION RATE}=(Kt/Ko)\times 100\%$$

Thus, the loss rate (dropping ratio) of heat transmission or fouling rate can be known and shown through the monitor 8, and the operator can monitor the efficiency of the heat exchanging process. By means of employing the new coefficient of heat conductivity Kt to the aforesaid equations (1) and (2), the new value of the thickness DXt of the heat exchanging tube 10 after fouling is obtained as:

$$DXt = \frac{-2WxC(T4-T3)}{KtxA[(T1-T3)+(T2-T4)]} \quad (4)$$

An electric heater may be installed in the heat exchanging chamber 1 and used as a heat source to directly heat water in the heat exchanging chamber 1 to the desired temperature, and a float valve 9 may be installed in the heat exchanging chamber 1 to automatically control the water level.

It is to be understood that the drawings are designed for purposes of illustration only, and are not intended as a definition of the limits and scope of the invention disclosed.

What the invention claimed is:

1. A on-line monitoring system of a simulated heat-exchanger monitoring system comprising:

a heat exchanging chamber for the performance of a heat exchanging process, having one heat exchanging tube passing therethrough, a hot water inlet, and a hot water outlet, said heat exchanging tube having a cold water inlet at one end, and a cold water outlet at an opposite end;

a heat source installed in said heat exchanging chamber outside said heat exchanging tube, and controlled to heat said heat exchanging tube through water passing through said heat exchanging chamber;

a first temperature sensor T1 installed in said hot water inlet;

a second temperature sensor T2 installed in said hot water outlet;

a third temperature sensor T3 installed in said cold water outlet;

a fourth temperature sensor T4 installed in said cold water inlet;

a flowrate detector installed in said heat exchanging tube outside said exchanging chamber to detect the flow rate of water W passing through said heat exchanging tube;

an analog-to-digital converter connected to said temperature sensors and said flowrate detector to convert detected temperature signals and flowrate signal into corresponding digital signals; and a microprocessor connected to said analog-to-digital converter, said microprocessor being connected with a data output device, a memory, and a data input device; wherein after receiving digital data from said analog-to-digital converter, said microprocessor computes the heat transmission rate subject to the heat transmission equation stored in said memory that total heat flow rate Q is directly proportional to heat transmission area A and temperature difference of object DT, and indirectly proportional to thickness of object DX, i.e., $$Q1 = -KA\frac{DT}{DX} \quad (1)$$

in which:

"-": heat transmission from high temperature toward low temperature

Q: coefficient of heat conductivity

K: heat transmission constant

A: heat transmission area

DT: temperature difference at heat transmission surface

DX: thickness of heat transmission surface so as to obtain the total heat flow rate as:

$$Q1 = -KOA\frac{(T1-T3)+(T2-T4)}{2DX}$$

and to obtain the total heat transmission rate as:

$$Q2 = W \times C \times \Delta T \quad \ldots (2)$$

in which: Q2: total heat absorption capacity

W: weight of heat absorbing liquid

C: specific heat of heat absorbing liquid

ΔT: temperature difference before and after heat absorption (T3, T4);

if the temperature difference between the two opposite ends of the heat exchanging tube before and after heat absorption is ΔT=T4-T3, the weight or flow rate of cold water is W, and the specific heat is C, thus the total heat absorption capacity is:

$$Q2 = WC(T4-T3);$$

according to the aforesaid equations (1) and (2), if Q1=Q2, thus the heat transmission constant K0 of the heat exchanging tube 10 is:

$$KO = \frac{-2xDXxWxCx(T4-T3)}{Ax[(T1-T3)+(T2-T4)]} \quad (3)$$

the K0 value thus obtained is stored in said memory for use as a reference value for the calculation of a next heat transmission rate by said microprocessor; because the inside wall of said heat exchanging tube will produce a fouling resistance when it is covered with fouling causing the value of the coefficient of heat transmission to drop, thus the heat transmission rate and the thickness of fouling of said heat exchanging tube can be calculated by comparing the latest coefficient of heat transmission with the previous coefficient of heat transmission K0, said microprocessor outputting, responsive to said coefficient of heat transmission, at least one of an indication or a control action.

2. The on-line monitoring system of a simulated heat-exchanger of claim 1 wherein further comprising an area type flow meter mounted in said heat exchanging tube outside said heat exchanging chamber for visually checking the flow rate and velocity of the flow of water passing through.

3. The on-line monitoring system of a simulated heat-exchanger of claim 1 wherein said microprocessor is connected to a printer, and a personal computer through a RS-232 interface, so that the data of the temperature signals detected by said temperature sensors T1, T2, T3, T4, the flow rate signal detected by said flowrate detector, the calculated heat transmission constant can be automatically printed out through said printer.

4. The on-line monitoring system of a simulated heat-exchanger of claim 1 wherein said heat source is an electric heater.

5. The on-line monitoring system of a simulated heat-exchanger of claim 1 wherein a solenoid valve is installed in said hot water inlet and controlled by said microprocessor to control the passage of said hot water inlet.

6. The on-line monitoring system of a simulated heat-exchanger of claim 1 wherein a float valve is mounted inside said heat exchanging chamber to automatically control the water level.

7. The on-line monitoring system of a simulated heat-exchanger of claim 1 wherein said microprocessor is connected to a heating control switch, a warning device, and a timer through a control port thereof, so that said microprocessor drives said warning device to give a warning signal and stops the operation of the system when the operation of the system is abnormal.

8. The on-line monitoring system of a simulated heat-exchanger of claim 1 wherein said heat source is a low-pressure saturated evaporator.

9. The on-line monitoring system of a simulated heat-exchanger of claim 1 wherein said output device is a monitor.

10. The on-line monitoring system of a simulated heat-exchanger of claim 1 wherein said output device is a printer.

11. The on-line monitoring system of a simulated heat-exchanger of claim 1 wherein said output device is a recorder.

12. The on-line monitoring system of a simulated heat-exchanger of claim 1 wherein said output device is a magnetic tape driver.

13. The on-line monitoring system of a simulated heat-exchanger of claim 1 wherein said input device is a keyboard.

14. The on-line monitoring system of a simulated heat-exchanger of claim 1 wherein said input device is a light pen.

* * * * *